United States Patent [19]

Walmer et al.

[11] 4,219,960

[45] Sep. 2, 1980

[54] DOLL HOUSE

[76] Inventors: Harry E. Walmer, 721 N. Overlook Dr., Alexandria, Va. 22305; Judd Horbaly, 125 Commonwealth Ave., Alexandria, Va. 22309

[21] Appl. No.: 878,259

[22] Filed: Feb. 16, 1978

[51] Int. Cl.[2] ..... A63H 3/52

[52] U.S. Cl. ..... 46/19

[58] Field of Search ..... 46/19, 21

[56] References Cited

U.S. PATENT DOCUMENTS

| | | | |
|---|---|---|---|
| 3,906,659 | 9/1975 | Walmer | 46/19 |
| 3,996,693 | 12/1976 | Walmer | 46/19 |

*Primary Examiner*—F. Barry Shay

*Attorney, Agent, or Firm*—James Creighton Wray

[57] ABSTRACT

The invention relates to a doll house of the collapsible type having a novel design constructed from various panels comprising walls, floors, roofs, etc. and when assembled together form a large house having at least 12 rooms and has a French Victorian style. The panels have grooves, slots, holes, etc. whereby they fit together easily and support one another. No tools or screws are required for construction and the parts are locked together tightly in a rigid structure by the simple insertion of a plurality of small pegs in matching holes provided in the various panels. A feature of the doll house is the provision of unique first, second and third floor members in combination with side wall members which provide additional side rooms for the doll house. Another feature are unique front steps, porch and balcony arrangement.

10 Claims, 14 Drawing Figures

FIG. 1
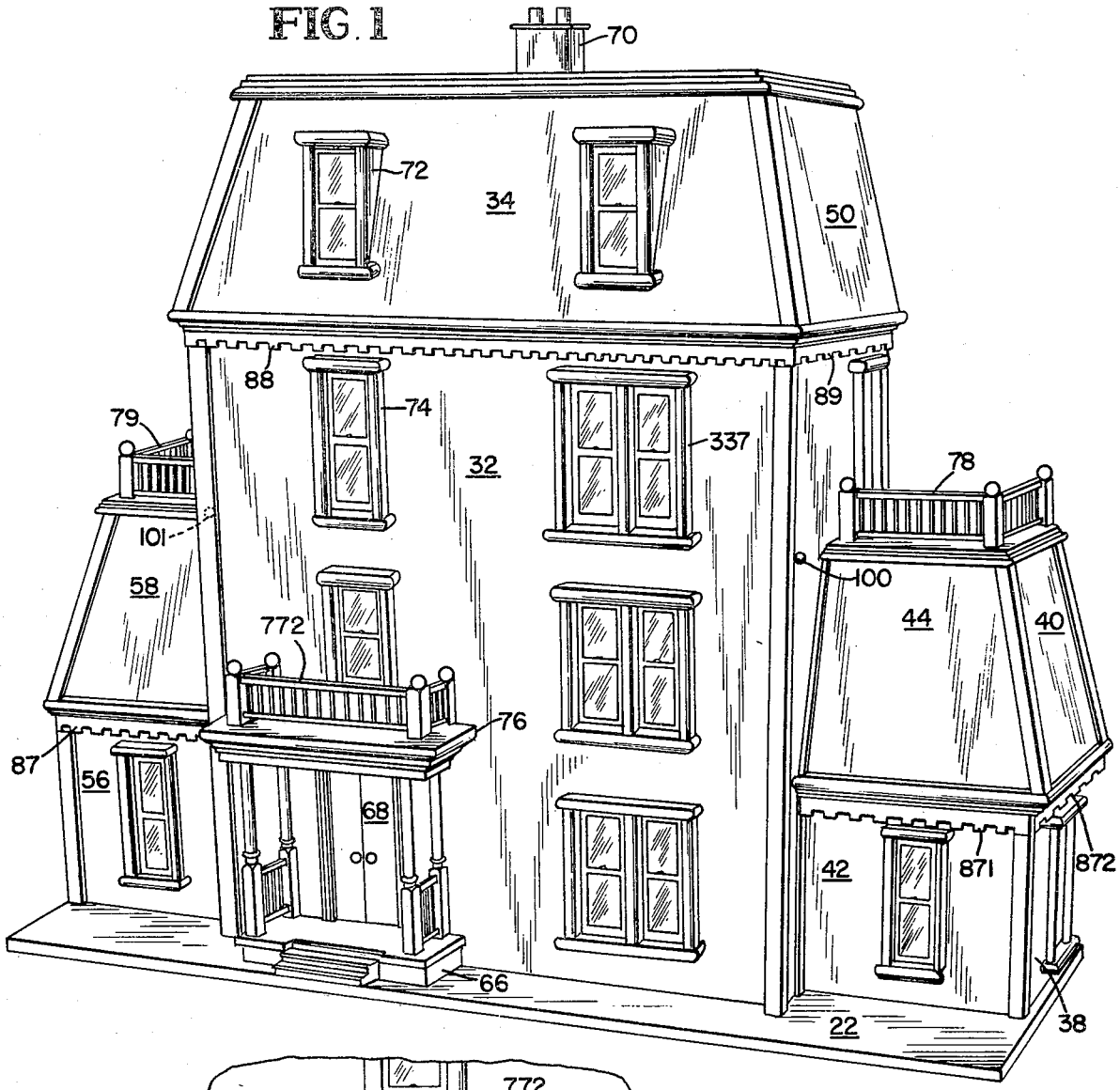
FIG. 2
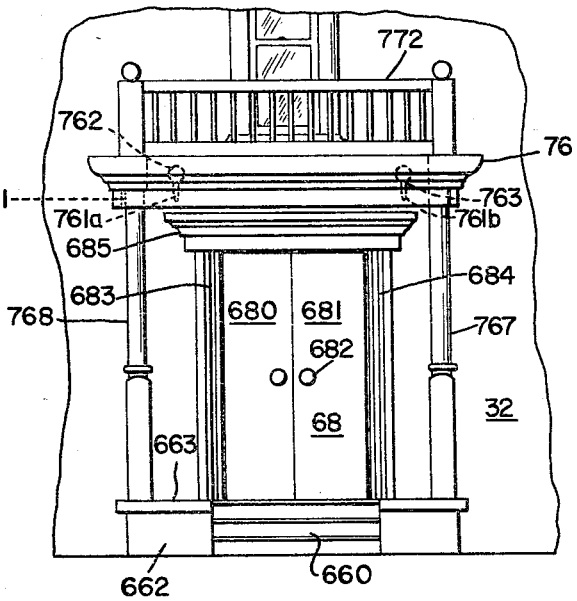
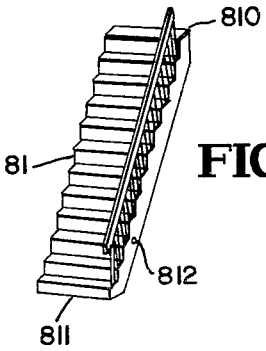
FIG. 14

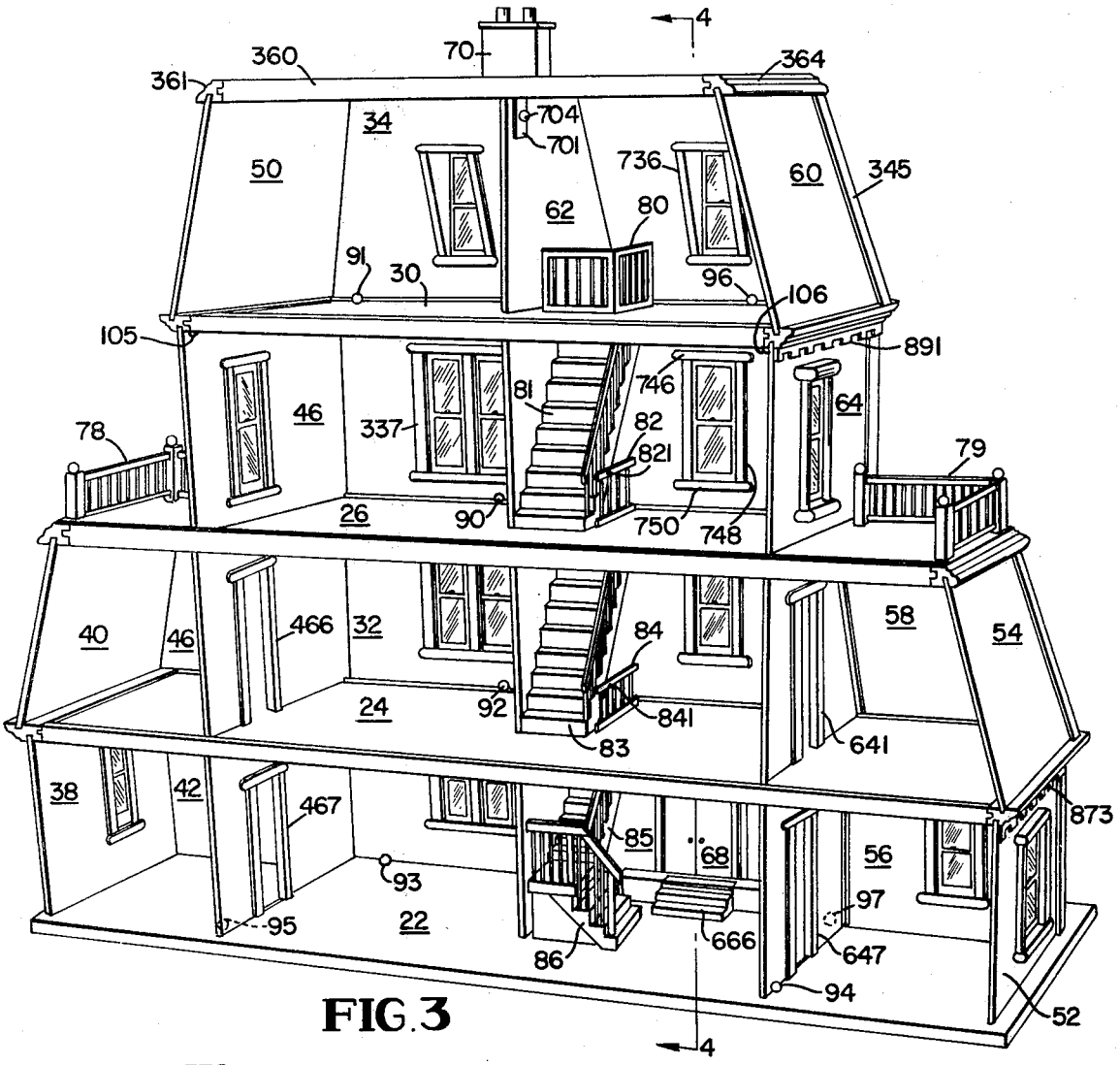
FIG. 3
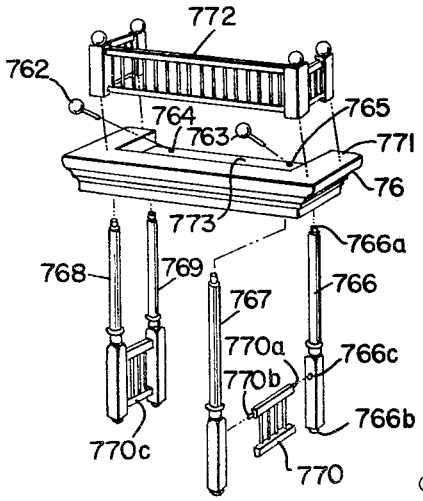
FIG. 6
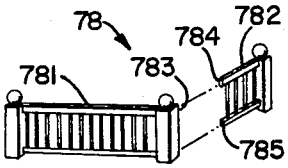
FIG. 7
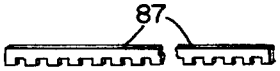
FIG. 8
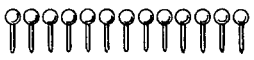
PEGS 50
46
44
42
40
38
36
34
32
30
26
24
22
60
62
68
58
56
54
70

DOLL HOUSE

INTRODUCTION

This invention relates to a doll house of the knock-down or collapsible type of simplified construction capable of being easily constructed or taken apart.

Although there are many types of doll houses which provide recreation and education to children and adults, many of them are of the permanent type presenting problems with shipping and storage. Others, which are of the knock-down type are relatively complicated in construction and require various types of fasteners and locking members to hold the doll house together. These doll houses, for the most part require tools and screws for construction and lack the desired rigidity when constructed. Furthermore, more sturdy types of doll houses, which can be easily knocked-down, are desired by various adult hobbyists. These doll houses are required to have open access to the various floors in order that the hobbyists can set up various furniture arrangements, etc. Interior decorators also find the doll houses useful in planning the furniture arrangements, etc. of rooms. In particular, it has been desirable to have a doll house with a large number of rooms to provide space for a large number of furniture arrangements, etc. A unique design of the present doll house includes first, second and third floor members in combination with side wall members to provide desired additional side rooms for the doll house.

Applicant has developed a unique series of doll houses capable of being knocked down as represented by U.S. Pat. Nos. 3,906,659; 3,996,693; 4,021,960 and 4,018,001.

BRIEF SUMMARY OF THE INVENTION

This invention relates to a doll house of the knock-down or collapsible type of simplified construction, capable of being easily constructed or taken apart for convenient storage. A unique design provides for a front entrance porch and balconies, and a large number of rooms from a minimum number of extended floor and wall panels provided with grooves and slots so that all parts slide together easily and support one another. The assembling of the doll house is easily done in minutes and does not require any tools or screws. Once assembled, all the parts are locked together by the insertion of several small pegs between adjacent parts to provide a rigid structure.

It is, therefore, an object of this invention to provide a doll house having a unique construction design capable of being easily assembled or constructed without special skill or the use of tools and fasteners, which can be easily disassembled or knocked-down for storage or transport purposes.

Another object of this invention is to provide a doll house that is relatively rigid and sturdy in construction when assembled requiring only simple pegs for holding the assembled house together.

A further object of this invention is to provide a doll house constructed from a novel arrangement of floor and wall panels provided with grooves and slots whereby assembly or disassembly of the doll house is facilitated.

Another object of this invention is to provide a novel floor construction for a doll house whereby additional rooms are provided for the doll house.

Another object of this invention is to provide a novel front door, porch and balcony construction in the front wall of the doll house.

A still further object of this invention is to provide novel, unique window constructions in the walls of the doll house.

Other objects, advantages and features of the invention will become apparent from the following detailed description of a preferred embodiment of the invention when considered with the accompanying drawings.

BRIEF DESCRIPTION OF THE DRAWINGS

FIG. 1 is a perspective view of the front of the doll house as fully assembled embodying the novel aspects of the invention;

FIG. 2 is an enlarged fragmentary front plan view of the front door, porch and balcony in the front wall of the doll house;

FIG. 3 is a perspective view of the back of the doll house fully assembled disclosing details of the interior rooms thereof;

FIG. 6 is an exploded, perspective view of the construction of the front balcony and portions of the porch disclosing details of the construction thereof;

FIG. 7 is a perspective view of a balcony rail which is located on a roof portion of the doll house;

FIG. 8 is a perspective view of a section of decorative molding used on the outside of the doll house;

FIG. 14 is a perspective view of a typical staircase installed between floors of the doll house.

DETAILED DESCRIPTION OF THE INVENTION

Figure 5:
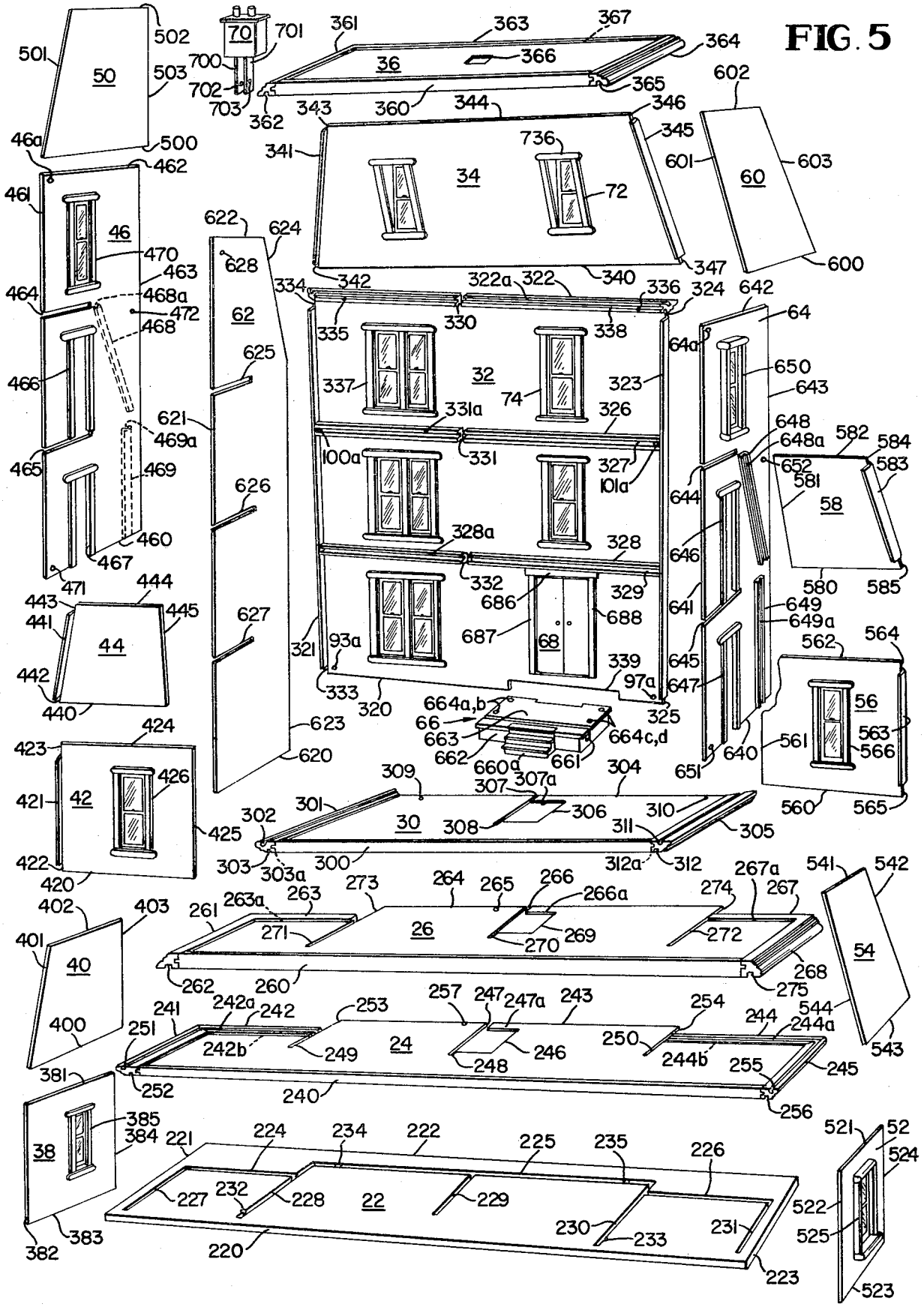
FIG. 5 is an exploded perspective view as seen from the back as in FIG. 3 disclosing all the panels, walls, floors and various parts of the doll house.

Referring to the drawings, FIG. 1 shows a front perspective view and FIG. 3 shows a perspective rear or back view of the doll house embodying the unique features of the invention. Both views show the doll house fully assembled and ready for use as a recreational device or as a model house for display purposes with miniature furniture arrangements, etc. FIG. 5 is an exploded perspective rear view disclosing the manner in which the various parts are assembled together. In the subsequent discussion of the doll house reference to left and right is as seen from the rear of the doll house.

The doll house generally comprises four floors 22, 24, 26 and 30; a mansard type-roof comprising roof members 36 and side roof panels 34, 50 and 60; front wall 32 and side walls 46 and 64; a center wall divider 62; two left side rooms; two right side rooms; front porch 66, entrance doors 68, and balcony 76; typical windows 72, 74 and 337; chimney 70; typical staircase 81 and guard rail 82; balcony and roof guard rails 78, 79 and 772; and typical decorative molding 87.

The first floor member 22 comprises a rectangular base with sides 220, 221, 222 and 223 having grooves 224, 225 with holes 234 and 235, 226, 227, 228, with hole 232, 229, 230, with hole 233 and 231 in the top surface. Second floor member 24 comprises a rear beam 240; left side beam 241 with grooves 252 and 251, and right side beam 245 with grooves 256 and 255; front beam member 242 with groove 242*a* and beam 244 with groove 244*a;* forward edge member 243 with sides 253 and 254 having slots 249 and 250 respectively, extending inwardly therefrom; stairwell 246 with rear slot 248; open end forward slot 247, and landing 247*a;* and hole 257. Third floor member 26 comprises a rear beam 260; left side beam 261 with groove 262; right side beam 268 with groove 275; front beam members 263 and 267; forward edge member 264 with sides 273 and 274 having slots 271 and 272, respectively extending inwardly therefrom; stairwell 269 with rear slot 270, open end forward slot 266, and landing 266*a;* and hole 265. Fourth floor member 30 comprises a rear beam 300; left side beam 301 with grooves 302 and 303; right side beam 305 with grooves 311 and 312; front edge 304; stairwell 306 with rear slot 308, open end forward slot 307 and landing 307*a;* and holes 309 and 310.

The main roof structure is a mansard type and comprises roof member 36, front roof panel 34, and side roof panels 50 and 60. Roof 36 comprises rear beam 360; left side beam 361 with groove 362 and right side beam 364 with groove 365; front beam 363 with groove 367, and chimney opening 366. Side roof panel 50 comprises edges 500 to 503 and similarly roof panel 60 comprises edges 600 to 603. Front roof panel 34 comprises top and bottom edges 344 and 340, left side edges 342 and 343 and L-beam 341, right side edges 346 and 347 and L-beam 345, and windows 72.

Front wall 32 comprises a bottom edge 320 containing a recessed edge portion 339; left side edges 333 and 334 with L-beam 321; right side edges 324 and 325 with L-beam 323; top beam 322 having grooves 322*a* and 338, slot 330, and holes 335 and 336; second floor beam 328 having groove 329, slot 332 and hole 328*a;* third floor beam 326 having groove 327, slot 331 and hole 331*a;* doorway frames 687, 688 and 686 with French doors 68 comprising door members 680 and 681 having a knob 682; windows 74 and 337, and the front wall on the outside contains a beam member 761 containing holes 761*a* and 761*b* (FIG. 2).

Left side wall 46 comprises bottom edge 460, top edge 462, side edges 461 and 463, intermediate slots 464 and 465, beam 468 with groove 468*a*, beam 469 with groove 469*a*, window 470, doorways 466 and 467, and hole 471. Similarly, right side wall 64 comprises bottom edge 640, top edge 642, side edges 641 and 643, intermediate slots 644 and 645, beam 648 with groove 648*a*, beam 649 with groove 649*a*, window 650, doorways 646 and 647, and hole 651.

The center wall partition 62 comprises bottom edge 62, top edge 622, leading edge 624 and side edges 623 and 621, and hole 628.

The two left side rooms comprise the overhangs of floors 24 and 26; upper side wall 40 with edges 400–463; lower side wall 38 with edges 381–384 and window 385; upper front wall 44 having edges 440, 442, 443, 444, 445 and L-beam 441; and lower front wall 42 having edges 420, 422, 423, 424, 425, L-beam 421 and window 426.

The two right side rooms comprise the overhangs of floors 24 and 26; upper side wall 54 with edges 541–544; lower side wall 52 with edges 521–524 and window 525; upper front wall 58 having edges 580, 581, 582, 584 and 585, and L-beam 583; and lower front wall 56 having edges 560, 561, 562, 564, 565, L-beam 563 and window 566.

The porch 66 comprises front steps 660 on the front of the porch, landing 663, steps 660*a* leading to the interior of the house, and porch foundation member 662 containing groove 661 and holes 664*a, b, c* and *d*. Balcony 76 comprises a rail ledge 771, rail 772, landing 773, holes 764 and 765 and columns 766–769 with rails 770, 770*a*.

The various members of the doll house are adapted to be assembled together and held together with pegs as follows. The first floor 22 is placed on a level surface, porch 66 is placed across groove 225, and bottom edge 320 of front wall 32 is inserted in groove 225 while at the same time inserting edge 339 into groove 661 of the porch. The front wall and porch are then secured in place by inserting pegs 93 and 97 in holes 93*a* and 97*a* of wall 32 and holes 234 and 235 of the first floor. The bottom edge 460 of side wall 46 is inserted in groove 228 and edge 463 is abutted against the inside of L-beam 321. Peg 95 is inserted in hole 471 and hole 232 of groove 228, and peg 100 (FIG. 1) is inserted in hole 472 and hole 100*a* in the left end of beam 326. Similarly, bottom edge 640 of side wall 64 is inserted in groove 230 and edge 643 is abutted against the inside of L-beam 323. Peg 94 is inserted in hole 471 and hole 233 of groove 230, and peg 101 (FIG. 1) is inserted in hole 652 and hole 101*a* in the right end of beam 326. The front wall 32 and side walls 46 and 64 are now secured together to the first floor.

The edge 620 of center wall partition 62 is installed in groove 229 of the first floor and edge 623 are inserted into slots 330, 331 and 332 of the front wall beams which retain the divider in a firm vertical position. The second floor 24 is installed by engaging and sliding slots 249 and 250 into slot 465 of left side wall 46 and into slot 645 of right side wall 64, respectively, and at the same time engaging and sliding slot 247 into slot 627 of divider 62. The entire floor is moved forward until edge 243 engages groove 329 of beam 328, slot 248 is firmly engaged in the end of slot 627, and beam 240 abuts edges 461 and 641 of the side walls. Peg 92 is then inserted in hole 257 and hole 328*a* of beam 328 to retain the second floor firmly in place.

The third floor 26 is installed similarly as the second floor by engaging and sliding slots 271 and 272 into slot 464 of left side wall 46 and into slot 644 of right side wall 64, respectively, and at the same time engaging and sliding slot 266 into slot 626 of divider 62. The entire floor is moved forward until edge 264 engages groove 327 of beam 326, slot 270 is firmly engaged in the end of slot 626, and beam 260 abuts edges 461 and 641 of the side walls. Peg 90 is inserted in hole 265 and hole 331*a* of beam 331 to retain the third floor firmly in place.

At this stage of construction, the two left side rooms and the two right side rooms are constructed. With the second and third floors installed as above set forth, each extends and overhangs beyond the side walls 46 and 64. The left side of first floor 24 is flexed slightly upwardly and left lower front wall 42 is installed by inserting edge 420 in groove 224 of the first floor, edge 424 in groove 242*b* of beam 242 of the second floor, and edge 425 in groove 469*a* of beam 469 of left side wall 46. Lower left side wall 38 is installed by inserting edge 383 in groove 227 of the first floor and edge 381 in groove 252 of beam 241 of the second floor. By pushing edge 382, edge 384 of wall 38 is eventually engages the inner part of L-beam 421, whereby walls 42 and 38 are firmly secured in place. Similarly left upper front wall 44 is installed by flexing the left side of third floor 26 and slightly upwardly and edge 440 is inserted in groove 242*a*, edge 444 in groove 263*a* of beam 263 of the third floor, and edge 445 in groove 468*a* of beam 468 of the left sidewall 46. Upper left side wall 40 is installed by inserting edge 400 in groove 251 of beam 241, edge 402 in groove 262 of beam 261, and sliding wall 40 forward by pushing edge 401 until edge 403 engages the inner part of L-beam 441, whereby walls 40 and 44 are firmly secured in place.

The two right side rooms are installed similarly as the two left side rooms. Right lower front wall 56 edges 560, 561 and 562 are inserted in grooves 226, 649*a*, and 244*b* respectively. Lower right side wall 52 edges 523, 524, and 521 are inserted in groove 231, L-beam 563, and groove 256, respectively. Right upper front wall 58 edges 580, 582 and 581 are inserted in grooves 244*a*, 267*a*, and 648*a*, respectively. Upper right side wall 54 edges 543, 542, and 541 are inserted in groove 255, L-beam 583, and groove 275.

The fourth floor 30 is next installed by engaging and sliding slot 307 in slot 625 of divider 62, edge 462 of left side wall 46 in groove 303 of beam 301, and edge 642 of right side wall 64 in groove 312 of beam 305. The entire floor is moved forward until edge 304 engages groove 322*a* of beam 322 of front wall 32, slot 308 engages the end of slot 625, and the mitered left and right ends of beam 322 engage the mitered forward ends of beams 301 and 305, respectively. Peg 91 is inserted in hole 309 of floor 30 and hole 335 of beam 322 of the front wall 32. Similarly, peg 96 is inserted in hole 310 and hole 336. Peg 105 is inserted in hole 46*a* of left side wall 46 and hole 303*a* in groove 303 of beam 301, and similarly peg 106 is inserted in hole 64*a* of right side wall 64 and hole 312*a* in groove 312 of beam 305. Pegs, 91, 96, 105 and 106 retain the fourth floor firmly in place.

Figure 10:
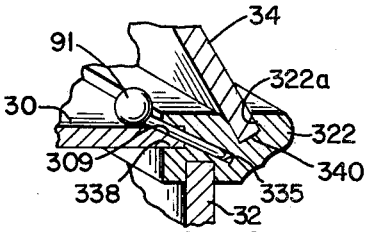
FIG. 10 is an enlarged, fragmentary, rear, cross-sectional, perspective view of the assembled front roof panel, fourth floor, front wall, and front horizontal beam member disclosing details of how they are held together by a peg.

The mansard roof structure is next installed (See FIGS. 4 and 10) by inserting bottom edge 340 of front roof panel 34 in groove 322*a* of beam 322. The panel 34 is designed to slant about 15° from the vertical in groove 322*a*, abuts against leading edge 624 of divider 62, and comprises left and right L-beams 341 and 345, respectively. Roof 36 is installed by inserting top edge 344 of panel 34 into groove 367 of beam 363 and in so doing the forward part of edge 622 of divider 62 is inserted in slot 367*a* of beam 363. The underside of roof panel 36 rests on edge 622 of divider 62, and edge 622 bisects chimney opening 366. Chimney structure 70 comprises two downwardly projecting parallel members 700 and 701 having holes 702 and 703, respectively, and spaced apart a distance a little greater than the thickness of divider 62. Chimney 70 is installed in the chimney opening 366 whereby members 700 and 701 straddle divider 62. Holes 702 and 703 are adapted to be aligned together and with hole 628 of the divider when the chimney is installed. A peg 704 (FIG. 4) is inserted through the three aligned holes, which provides rigidity and stability to the roof structure. Left side roof panel 50 is installed by inserting edge 500 into angled groove 302 of beam 301 and edge 502 into angled groove 362 of beam 361, and by pushing edge 501 whereby edge 503 eventually engages the inner part of L-beam 341. Similarly right side roof panel 60 is installed by inserting edge 600 in angled groove 311 of beam 305, edge 602 in angled groove 365 of beam 364, and edge 603 within L-beam 345.

Figure 4:
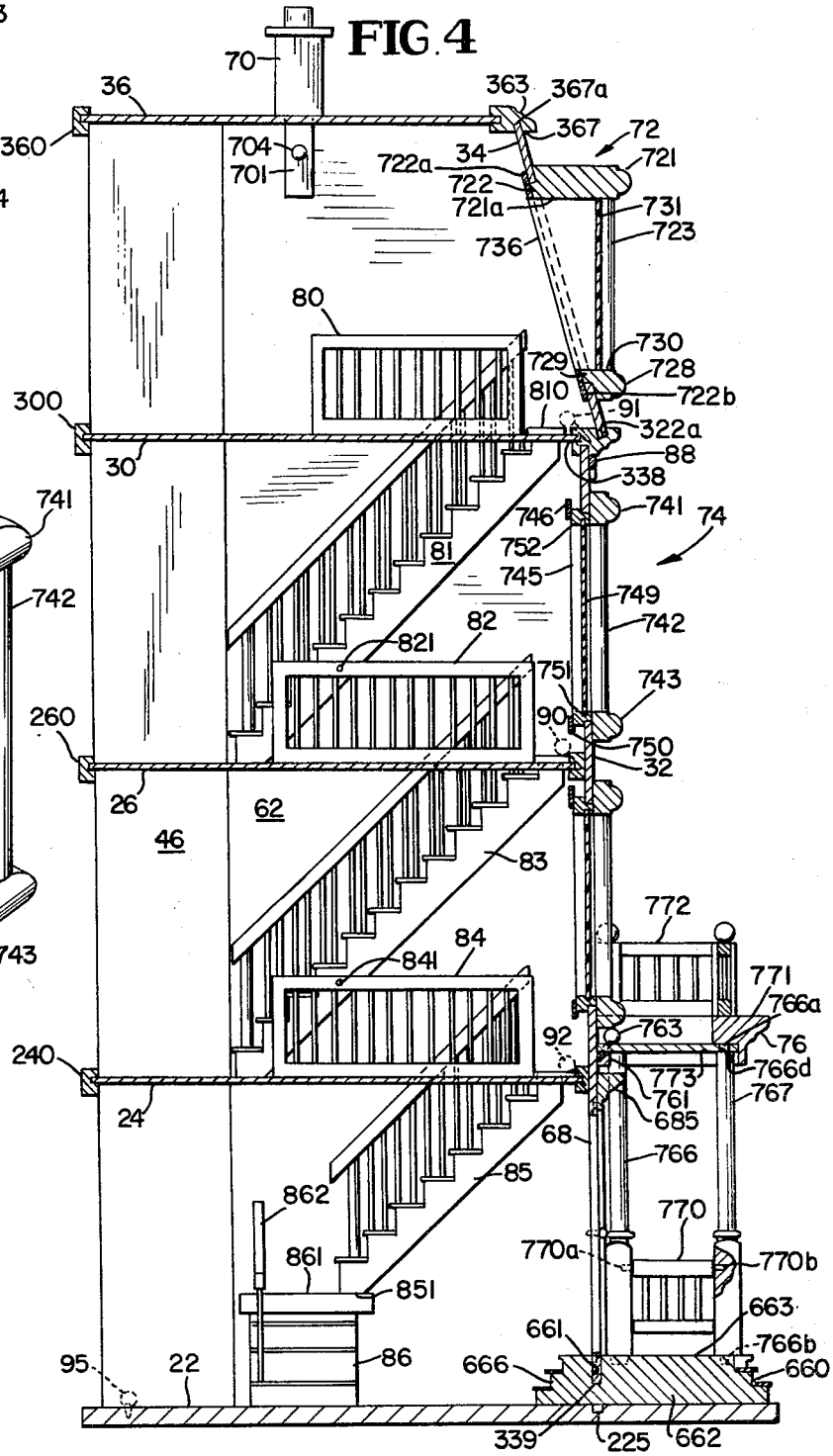
FIG. 4 is a cross section view of the doll house taken along line 4—4 of FIG. 3.

The front porch and balcony are next assembled on the front wall 32 (see FIGS. 1, 2, 3, 4 and 6). Porch landing 663 has already been installed. The bottom pegs of the four posts 766–769 are installed in the respective holes 664*a*, *b*, *c*, *d* of the landing 663, e.g. peg 766*b* is installed in hole 664*b* of the landing. The balcony has matching holes at the underneath surface of landing 773 and the top pegs of posts 766–769 are inserted therein respectively, e.g. 766*a* in hole 766*d* (FIG. 4). The rear edge of landing 773 abuts the front surface of wall 32 and rests on a horizontal beam member 761 (FIG. 4) secured to front wall 32, which has a pair of holes (not shown), and pegs 762 and 763 are inserted in holes 764 and 765 of the landing and the pair of holes of the beam 761, respectively. This construction secures the porch and balcony together. Rails 770 and 770*c* can be installed between the posts, e.g. rail 770 has pins 770*a* and 770*b* which are inserted in respective holes of the posts such as hole 766*c* of post 766. A decorative rail 772 can also be placed on ledge 771 of the balcony. Similarly, decorative rails 78 and 79 can be placed on the top end surfaces of the third floor 26. Rail 78, for example, is constructed by joining sectional rails 781 and 782 together by inserting pegs 784 and 785 in respective holes of rail post 783.

As shown in FIGS. 3, 4, 5 and 14, unitary staircases and guard rails are installed between the second, third and fourth floors against divider 62. For example, bottom 811 of staircase 81 installed between the third and fourth floors rests on third floor 26 and the upper landing 810 has been inserted in stairwell 306 and rests on floor portion 307*a*. Similarly, staircase 83 rests on second floor 24 and extends into stairwell 269 and rests on floor portion 266*a*. Guard rails 82 and 84 are installed on each floor adjacent the respective stairwells. Rail 82 is secured to staircase 81 by means of a pin 821 in hole 812 in the side of the staircase. Similarly, rail 84 is secured to staircase 83 by means of a pin 841 in a hole (not shown) in the side of the staircase. The staircase between the first and second floors comprises an intermediate landing 861 formed from the two staircases 85 and 86. Staircase 86 with integral rail 862 is installed against divider 62, and staircase 85 is installed by placing its bottom 851 on the landing 861 and inserting the upper portion into stairwell 246 so that the landing thereof rests on second floor portion 247*a*. A guard rail 80 is also installed on the fourth floor around stairwell 306.

Figure 12:
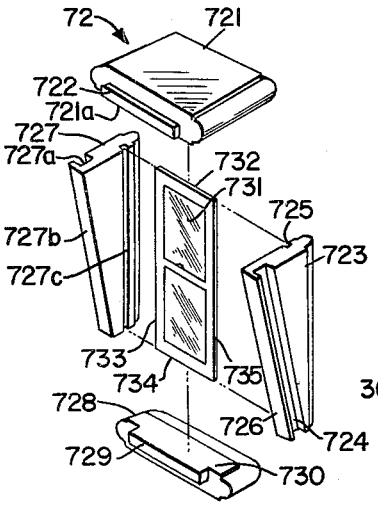
FIG. 12 is an enlarged perspective view of a novel window construction installed in the mansard type roof construction of the doll house.
Figure 9:
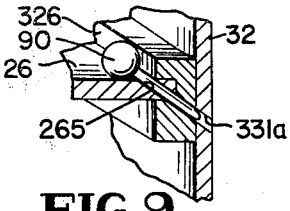
FIG. 9 is an enlarged, fragmentary, rear, cross-sectional, perspective view of the assembled right side wall and third floor disclosing details of how they are held together by a peg.

The several outside walls of the doll house comprise a unique series of window constructions. A typical window for the front roof panel 34 is denoted by the numeral 72 (see FIGS. 4 and 12) and comprises dormer window framework members 721, 723, 727 and 728, and an integral window pane 731 having frame members 732–735. The two side framework 723 and 727 each comprise grooves 724, 725 and 727*a*, 727*c*, respectively, and a rear edge surface 727*b* and 726, respectively. Framework member 721 comprises a rearward projecting edge portion 722 and a bottom surface 721*a*. Framework member 728 comprises a rearward projecting portion 729 and a top surface 730. The window 72 is installed permanently as by glueing, etc. in a rectangular window opening in roof panel 34 by inserting edge portion 722 of member 721 into the top of the window opening, and edge portion 729 of member 728 into the bottom of the window opening. Framework member 723 is permanently installed by inserting groove 724 onto the right side of the window opening, and similarly member 727 is installed by inserting groove 727*a* onto the left side of the window opening. Window pane 731 is installed by being flexed and inserting frame 735 into groove 725, frame 733 into groove 727*c*, edge of frame 732 abuts surface 721*a*, and edge 734 abuts surface 730. The inner wall of panel 34 around the window is trimmed by permanently installing inner trim members such as 722*a* and 736.

Figure 13:
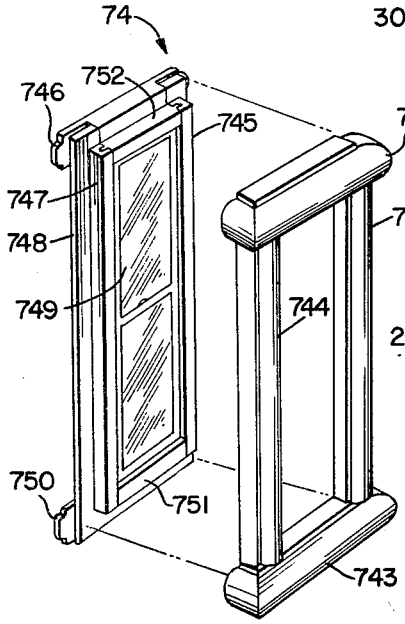
FIG. 13 is an enlarged, perspective view of a novel window construction installed in the front and side walls of the doll house.
Figure 11:
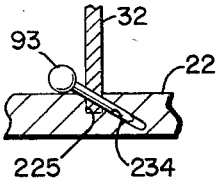
FIG. 11 is a side, cross-sectional view of the assembled first floor and front wall disclosing details of how they are held together by a peg.

Typical window 74 (FIGS. 4 and 13) is installed on the vertical walls of the doll house such as on front wall 32, and comprises an outer framework 741–744 and an inner integral window pane and frame including window pane 749 with recessed frame members 745, 747, 751 and 752 bounded by an inner rectangular frame 748 and trim members 746 and 750. The integral window pane and associated framework are permanently installed from the inside of wall 32 into a window opening with frame 745, 747, 751 and 752 within the opening and the outer framework is permanently installed around the outside of the window opening. Typical double window 337 is similar in construction to window 74 with the exception that two integral window panes are used with a central vertical member.

Decorative molding members such as 87, 88 (FIG. 8) 871, 872, 873, 891 are permanently secured to various areas of the outside walls of the doll house.

The above description of the invention is deemed to be the most practical and efficient embodiment and it should be understood that the invention is not limited to such embodiment as there might be changes made in the arrangement, disposition and form of the parts without departing from the principle of the present invention within the scope of the accompanying claims.

What is claimed is:

1. An easily assembled knock-down doll house, the parts of which are fitted together and held together with pegs comprising:

a. a generally rectangular first floor member comprising a center front groove and offset parallel left and right front grooves, parallel pairs of left and right grooves and a center groove parallel to said left and right grooves perpendicular to said front grooves in the top surface thereof;

b. a front wall member having a size and shape adapting it to have its bottom edge engage said center front groove of said first floor member, comprising vertical L-shaped side beams, a top horizontal beam member, upper and lower horizontal intermediate beam members on the inner front wall each containing a vertical slot and an inner groove, a doorway with door members disposed below said beam members, windows, and said bottom edge comprising a recessed portion parallel to the remaining portion thereof;

c. left and right side wall members having respective sizes and shapes adapting them to have their front edges engage said L-shaped beams of said front wall and their bottom edges engage respective grooves of one said pairs of left and right grooves of said first floor, each of said side walls containing two intermediate horizontal slots extending forwardly from the rear edge, lower front vertical and upper front rearwardly angled beam members each having an inward side groove, doorways disposed on said bottom edge and between said horizontal slots;

d. intermediate wall member having a size and shape adapting it to have its lower edge engage said center groove of said first floor and a forward edge engage said vertical slots of said horizontal beam members of said front wall, comprising at least three intermediate horizontal slots extending forwardly from the rear edge, and an angled leading edge;

e. a second floor member comprising forward and recessed leading edges with horizontal slots at their juncture extending rearwardly therefrom, a forward stairwell including a horizontal slot extending rearwardly from said forward leading edge, beam members on each side edge having an angled top groove and a bottom groove, beam members on said recessed leading edges each having top and bottom grooves, said floor member having a size and shape adapting it to have its horizontal slots engage a said intermediate horizontal slot of said intermediate wall member and a said intermediate slot of each of said left and right side walls, and its forward leading edge engage said groove of said lower horizontal beam of said inner front wall;

f. a third floor member comprising forward and recessed leading edges with horizontal slots at their juncture extending rearwardly therefrom, a forward stairwell including a horizontal slot extending rearwardly from said forward leading edge, beam members on each side edge and said recessed leading edges each having a bottom angled groove, said floor member having a size and shape adapting it to have its horizontal slots engage a said intermediate horizontal slot of said intermediate wall member and a said intermediate slot of each of said left and right side walls, and its forward leading edge engage said groove of said upper horizontal beam on said inner front wall;

g. a fourth floor member comprising a forward stairwell including a horizontal slot extending rearwardly from its forward edge, beam members on each side edge each having a top angled groove and a bottom groove, said floor member having a size and shape adapting it to have said horizontal slot engage a said intermediate slot of said intermediate wall member, said bottom grooves of its beam members engage top edges of said left and right side walls respectively, and its front edge engage said inner groove on said top horizontal beam member of said front wall member;

h. a horizontal roof member comprising left and right and front beam members each containing a bottom angled groove, and a front roof side panel having L-shaped beam members on its left and right side edges, said front roof side panel having a size and shape adapting it to have its bottom edge engage a top angled groove in said top beam member of said front wall member and its inner surface abut said angled leading edge of said intermediate wall member, said horizontal roof member having a size and shape adapting it to have its said bottom angled groove of said front beam member engage the top edge of said front roof side panel and its bottom surface abut the top edge of said intermediate wall member, left and right side roof panels having a size and shape adapted to engage respective bottom grooves in said left and right beam members of said horizontal roof member and said top angled grooves of said side beam members of said fourth floor;

i. left and right second front walls having a size and shape adapting them to have their bottom edges respectively engage said offset left and right grooves of said first floor, their top edges respectively engage said bottom grooves of said beam members on said recessed leading edges of said second floor, their left edges respectively engage grooves on said vertical beam on said left and right side walls, and comprising L-shaped beam members on respective left and right side edges;

j. left and right second side walls each having a size and shape adapting them to have their bottom edges respectively engage parallel left and right grooves in said first floor, and their front edges to respectively engage said L-shaped beam members on said left and right second front walls;

k. left and right third front walls having a size and shape adapting them to have their bottom edges respectively engage grooves on said beam members on said recessed leading edges of said second floor, their top edges respectively engage said bottom grooves of said beam members on said recessed leading edges of said third floor, their left and right edges respectively engaging said groove on said angled beam members on said left and right side walls, and comprising L-shaped beam members on respective left and right side edges;

l. left and right third side walls each having a size and shape adapting them to have their bottom edges respectively engage angled grooves in said beams on said side edges of said second floor, and their front edges to respectively engage said L-shaped beams on said left and right third floor walls.

m. a plurality of pegs having respective sizes and shapes adapting them to be inserted in holes contained in said beam members grooves, walls and floor members at their junctures with each other for retaining said assembled structure together.

2. The doll house of claim 1 wherein a porch landing member comprises front and rear stairs, and a longitudinal top groove intermediate thereon engages and straddles said recessed edge of said front wall member.

3. The doll house of claim 2 wherein said porch landing member comprises a plurality of vertical columns supporting a balcony member disposed on said front wall member.

4. The doll house of claim 3 wherein said front wall member comprises a horizontal beam member on its front surface, said balcony member is disposed thereon and said vertical columns, and pegs are disposed into said balcony member and said horizontal beam member.

5. The doll house of claim 1 wherein a removable angled staircase having a size and shape adapting it to be disposed between floor members in said stairwell comprises a first staircase disposed on a second staircase landing which is disposed on one of said floor members at 90° in relation to the first staircase.

6. The doll house of claim 1 wherein a dormer window is disposed in said front roof side panel comprising side framework members each having an outer groove adapted to engage a respective side of a window opening, inner grooves adapted to respectively engage the sides of a window pane member, top and bottom framework members engaging the top and bottom of said pane.

7. The doll house of claim 1 wherein a window is disposed in one of said front and side walls comprising a unitary outer window frame member and an inner unitary frame member including a window pane, said inner frame member comprising an outwardly projecting frame installed in a window opening.

8. The doll house of claim 1 wherein a chimney member containing a pair of parallel downwardly projecting members is adapted to be inserted in a roof hole in said horizontal roof member, to straddle the top edge of said intermediate wall member, and to be secured by a peg inserted in aligned holes in said intermediate wall and said parallel members.

9. The doll house of claim 2 wherein said front wall member comprises french doors opening onto said porch landing.

10. The doll house of claim 2 wherein said balcony comprises an integral rail.

* * * * *